US010150327B2

(12) United States Patent
Kokkelenberg et al.

(10) Patent No.: US 10,150,327 B2
(45) Date of Patent: Dec. 11, 2018

(54) LASER MARKABLE MATERIALS AND DOCUMENTS

(71) Applicant: AGFA-GEVAERT, Mortsel (BE)

(72) Inventors: Dirk Kokkelenberg, Mortsel (BE); Marin Steenackers, Mortsel (BE); Peter Bries, Mortsel (BE)

(73) Assignee: AGFA-GEVAERT, Mortsel (BE)

( * ) Notice: Subject to any disclaimer, the term of this patent is extended or adjusted under 35 U.S.C. 154(b) by 0 days.

(21) Appl. No.: 15/317,191

(22) PCT Filed: Jun. 12, 2015

(86) PCT No.: PCT/EP2015/063118
§ 371 (c)(1),
(2) Date: Dec. 8, 2016

(87) PCT Pub. No.: WO2015/189360
PCT Pub. Date: Dec. 17, 2015

(65) Prior Publication Data

US 2017/0120662 A1 May 4, 2017

(30) Foreign Application Priority Data

Jun. 13, 2014 (EP) ..... 14172285

(51) Int. Cl.

| | |
|---|---|
| ***B42D 25/23*** | (2014.01) |
| ***B42D 25/382*** | (2014.01) |
| ***B41M 5/46*** | (2006.01) |
| ***B41M 3/14*** | (2006.01) |
| ***B42D 25/00*** | (2014.01) |
| ***B42D 25/435*** | (2014.01) |
| ***B42D 25/24*** | (2014.01) |

(52) U.S. Cl.
CPC ..... *B42D 25/382* (2014.10); *B41M 3/142* (2013.01); *B41M 5/465* (2013.01); *B42D 25/00* (2014.10); *B42D 25/23* (2014.10); *B42D 25/24* (2014.10); *B42D 25/435* (2014.10)

(58) Field of Classification Search
CPC ..... B41M 3/14; B41M 3/142; B41M 5/262; B41M 5/267; B41M 5/323; B41M 5/46; B41M 5/465; B41M 2205/04; B41M 5/14; B41M 5/142; B42D 25/23
USPC ..... 503/201; 283/85, 94, 95, 107, 109, 84
See application file for complete search history.

(56) References Cited

U.S. PATENT DOCUMENTS 4,720,449 A 1/1988 Borror et al.
6,569,594 B2 * 5/2003 Damme ..... B41C 1/1016 430/270.1

FOREIGN PATENT DOCUMENTS

EP 2 181 858 A1 5/2010
EP 2 567 825 A1 3/2013
(Continued)

OTHER PUBLICATIONS

Official Communication issued in International Patent Application No. PCT/EP2015/063118, dated Aug. 5, 2015.

*Primary Examiner* — Bruce H Hess
(74) *Attorney, Agent, or Firm* — Keating and Bennett, LLP

(57) ABSTRACT

A laser markable material includes a laser markable layer, present as a self-supporting layer or as a layer on a support, the laser markable layer including an infrared absorbing dye and an infrared absorbing pigment, characterized in that the amount of the infrared absorbing pigment is between 10 ppm and 1000 ppm relative to the total dry weight of the laser markable layer.

14 Claims, 3 Drawing Sheets

(56) References Cited

FOREIGN PATENT DOCUMENTS

| | | | |
|---|---|---|---|
| EP | 2 719 540 | A1 | 4/2014 |
| EP | 2 648 920 | B1 | 3/2015 |
| WO | 2008/075101 | A2 | 6/2008 |
| WO | 2012/104006 | A1 | 8/2012 |

* cited by examiner

LASER MARKABLE MATERIALS AND DOCUMENTS

CROSS REFERENCE TO RELATED APPLICATIONS

This application is a 371 National Stage Application of PCT/EP2015/063118, filed Jun. 12, 2015. This application claims the benefit of European Application No. 14172285.0, filed Jun. 13, 2014, which is incorporated by reference herein in its entirety.

BACKGROUND OF THE INVENTION

1. Field of the Invention

This invention relates to laser markable articles, in particular to colour laser markable security documents.

2. Description of the Related Art

Security cards are widely used for various applications such as identification purposes (ID cards) and financial transfers (credit cards). Such cards typically consist of a laminated structure consisting of various paper or plastic laminates and layers wherein some of them may carry alphanumeric data and a picture of the card holder. So called 'smart cards' can also store digital information by including an electronic chip in the card body. A principal objective of such security cards is that they cannot be easily modified or reproduced in such a way that the modification or reproduction is difficult to distinguish from the original.

Two techniques frequently used for preparing security documents are laser marking and laser engraving. In literature, laser engraving is often incorrectly used for laser marking. In laser marking, a colour change is observed by local heating of material, while in laser engraving material is removed by laser ablation.

Well known in the field of laser markable security documents is the use of laser markable polymeric supports. Laser marking produces a colour change from white to black in a laser markable support through carbonization of the polymer, usually polycarbonate as disclosed in e.g. EP-A 2181858 (AGFA GEVAERT).

During the past last years, there is an increased interest of using laser markable layers. The advantage of using a laser markable layer coated on a support instead of a laser markable support, is that a support can be used which has better physical properties than the laser markable supports, such as for example a higher flexibility than a polycarbonate support as disclosed in e.g. EP-A 2567825 (AGFA GEVAERT).

There is also an increased interest in using laser marking to produce coloured images in a security document. Therefore, laser markable layers are used which are composed of colour forming compounds (also called "leuco-dyes") which can change from essentially colourless or pale-coloured to coloured when exposed to for example heat, such as disclosed in for example EP-A 2648920.

The colour laser markable layers may comprise an infrared absorbing dye (IR dye) or an infrared absorbing pigment (IR pigment), both absorbing the IR radiation and converting it into heat.

An advantage of using IR dyes is that the absorption spectrum of an IR dye tends to be narrower than that of an IR pigment. This allows the production of multicoloured articles and security documents from precursors having a plurality of laser markable layers containing different IR dyes and colour foming compounds. The IR dyes having a different maximum absorption wavelength can then be addressed by IR lasers with corresponding emission wavelengths causing colour formation only in the laser markable layer of the addressed IR dye. Such multicolour articles has been disclosed in for example U.S. Pat. No. 4,720,449 and EP-A 2719540.

A problem however when using such an IR dye in a colour laser markable layer is often a non-linear response of the obtained colour density as function of the exposure energy. This may result in an insufficient reproduction of details of a colour image, especially in the highlights, i.e. in the low densities of that image.

SUMMARY OF THE INVENTION

Preferred embodiments of the invention provide a laser markable material with an improved reproduction of details in the laser marked image. This advantage and benefit is realized by the laser markable material as defined below.

Further advantages and benefits of the invention provide a security document precursor and security document, comprising the laser markable material as defined below.

Further advantages and embodiments of the present invention will become apparent from the following description.

BRIEF DESCRIPTION OF THE DRAWINGS

In FIG. 1 and FIG. 2 the following numbering is adhered to:

11, 21=outer layer;
12, 22=polymeric support;
13, 23=intermediate layer;
14, 24=laser markable layer;
25=opaque white core support, e.g. white PETG FIG. 1 shows a cross section of an embodiment of a laser markable article according to the present invention.

FIG. 2 shows a cross section of another embodiment of a laser markable article according to the present invention.

DETAILED DESCRIPTION OF THE PREFERRED EMBODIMENTS

Definitions

Figure 1:
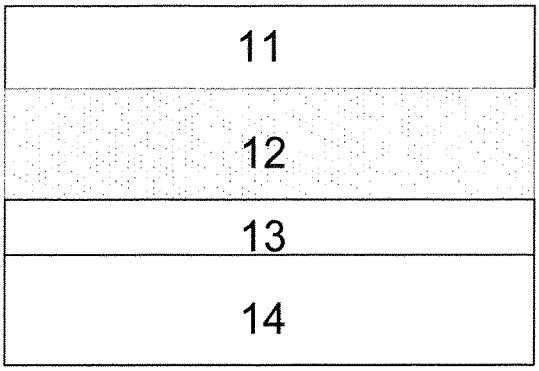

The terms polymeric support and foil, as used herein, mean a self-supporting polymer-based sheet, which may be associated with one or more adhesion layers, e.g. subbing layers. Supports and foils are usually manufactured through extrusion.

The term layer as used herein, is considered not to be self-supporting and is manufactured by coating it on a (polymeric) support or foil.

The term leuco dye as used herein refers to compounds which can change from essentially colourless or pale-coloured to coloured when irradiated with UV light, IR light and/or heated.

PET is an abbreviation for polyethylene terephthalate.

PETG is an abbreviation for polyethylene terephthalate glycol, the glycol indicating glycol modifiers which are incorporated to minimize brittleness and premature aging that occur if unmodified amorphous polyethylene terephthalate (APET) would be used in the production of cards.

PET-C is an abbreviation for crystalline PET, i.e. a biaxially stretched polyethylene terephthalate. Such a polyethylene terephthalate support has excellent properties of dimensional stability.

The definitions of security features correspond with the normal definition as adhered to in the Glossary of Security Documents—Security features and other related technical terms as published by the Consilium of the Council of the European Union on Aug. 25, 2008 (Version: v.10329.02.b.en) on its website:
http://www.consilium.europa.eu/prado/EN/glossaryPop-up.html.

The term security document precursor as used herein refers to the fact that one or more security features still have to be applied to the precursor, for example laser marking, in order to obtain the final security document.

The term alkyl means all variants possible for each number of carbon atoms in the alkyl group i.e. methyl, ethyl, for three carbon atoms: n-propyl and isopropyl; for four carbon atoms: n-butyl, isobutyl and tertiary-butyl; for five carbon atoms: n-pentyl, 1,1-dimethyl-propyl, 2,2-dimethyl-propyl and 2-methyl-butyl etc.

The term alkoxy means all variants possible for each number of carbon atoms in the alkyl group i.e. methoxy, ethoxy, for three carbon atoms: n-propoxy and isopropoxy; for four carbon atoms: n-butoxy, isobutoxy and tertiary-butoxy etc.

The term aryloxy means Ar—O— wherein Ar is an optionally substituted aryl group.

Unless otherwise specified a substituted or unsubstituted alkyl group is preferably a $C_1$ to $C_6$-alkyl group.

Unless otherwise specified a substituted or unsubstituted alkenyl group is preferably a $C_2$ to $C_6$-alkenyl group.

Unless otherwise specified a substituted or unsubstituted alkynyl group is preferably a $C_2$ to $C_6$-alkynyl group.

Unless otherwise specified a substituted or unsubstituted aralkyl group is preferably a phenyl group or a naphthyl group including one, two, three or more $C_1$ to $C_6$-alkyl groups.

Unless otherwise specified a substituted or unsubstituted alkaryl group is preferably a $C_1$ to $C_6$-alkyl group including an aryl group, preferably a phenyl group or naphthyl group.

Unless otherwise specified a substituted or unsubstituted aryl group is preferably a substituted or unsubstituted phenyl group or naphthyl group.

A cyclic group includes at least one ring structure and may be a monocyclic- or polycyclic group, meaning one or more rings fused together.

A heterocyclic group is a cyclic group that has atoms of at least two different elements as members of its ring(s). The counterparts of heterocyclic groups are homocyclic groups, the ring structures of which are made of carbon only. Unless otherwise specified a substituted or unsubstituted heterocyclic group is preferably a five- or six-membered ring substituted by one, two, three or four heteroatoms, preferably selected from oxygen atoms, nitrogen atoms, sulphur atoms, selenium atoms or combinations thereof.

An alicyclic group is a non-aromatic homocyclic group wherein the ring atoms consist of carbon atoms.

The term heteroaryl group means a monocyclic- or polycyclic aromatic ring comprising carbon atoms and one or more heteroatoms in the ring structure, preferably, 1 to 4 heteroatoms, independently selected from nitrogen, oxygen, selenium and sulphur. Preferred examples of heteroaryl groups include, but are not limited to, pyridinyl, pyridazinyl, pyrimidyl, pyrazyl, triazinyl, pyrrolyl, pyrazolyl, imidazolyl, (1,2,3,)- and (1,2,4)-triazolyl, pyrazinyl, pyrimidinyl, tetrazolyl, furyl, thienyl, isoxazolyl, thiazolyl, isoxazolyl, and oxazolyl. A heteroaryl group can be unsubstituted or substituted with one, two or more suitable substituents. Preferably, a heteroaryl group is a monocyclic ring, wherein the ring comprises 1 to 5 carbon atoms and 1 to 4 heteroatoms.

The term substituted, in e.g. substituted alkyl group means that the alkyl group may be substituted by other atoms than the atoms normally present in such a group, i.e. carbon and hydrogen. For example, a substituted alkyl group may include a halogen atom or a thiol group. An unsubstituted alkyl group contains only carbon and hydrogen atoms.

Unless otherwise specified a substituted alkyl group, a substituted alkenyl group, a substituted alkynyl group, a substituted aralkyl group, a substituted alkaryl group, a substituted aryl, a substituted heteroaryl and a substituted heterocyclic group are preferably substituted by one or more substituents selected from the group consisting of methyl, ethyl, n-propyl, isopropyl, n-butyl, 1-isobutyl, 2-isobutyl and tertiary-butyl, ester, amide, ether, thioether, ketone, aldehyde, sulfoxide, sulfone, sulfonate ester, sulphonamide, —Cl, —Br, —I, —OH, —SH, —CN and —$NO_2$.

Laser Markable Material

The laser markable material includes a laser markable layer, present as a self-supporting layer or as a layer on a support, the laser markable layer comprising an infrared absorbing dye (IR dye) and an infrared absorbing pigment, characterized in that the amount of the infrared absorbing pigment is between 10 ppm and 1000 ppm relative to the total dry weight of the laser markable layer.

In a preferred embodiment the laser markable layer is a colour forming layer comprising in addition to the infrared absorbing dye and the infrared absorbing pigment at least one leuco dye. The laser markable layer may further comprise a binder, an acid scavenger, and other ingredients to further optimize its properties.

The laser markable layer may be provided onto a support by co-extrusion or any conventional coating technique, such as dip coating, knife coating, extrusion coating, spin coating, spray coating, slide hopper coating and curtain coating. Preferably the laser markable layer is coated with a slide hopper coater or a curtain coater. The laser markable layer is preferably coated onto a transparent polymeric support including a subbing layer.

The dry thickness of the laser markable layer is preferably between 1 and 50 g/$m^2$, more preferably between 2 and 25 g/$m^2$, and most preferably between 3 and 15 g/$m^2$.

The laser markable material may comprise one, two, three or more laser markable layers. Preferably each laser markable layer contains an infrared absorbing dye, between 10 and 1000 ppm of an infrared absorbing pigment relative to the total dry weight of the laser markable layer, and a leuco dye.

A preferred laser markable material includes three laser markable layers, a first laser markable layer containing a first infrared dye IR-1 having an absorption maximum in the infrared region $\lambda_{max}$(IR-1), a second laser markable layer containing a second infrared dye IR-2 having an absorption maximum in the infrared region $\lambda_{max}$(IR-2) and a third laser markable layer containing a third infrared dye IR-3 having an absorption maximum in the infrared region $\lambda_{max}$(IR-3), wherein $\lambda_{max}$(IR-1)>$\lambda_{max}$(IR-2)>$\lambda_{max}$(IR-3), and wherein each laser markable layer further comprises between 10 and 1000 ppm of an infrared absorbing pigment relative to the total dry weight of the laser markable layer and a leuco-dye.

A preferred laser markable material includes the laser markable layer or layers as described above on a transparent polymeric support.

The laser markable material may in addition to the laser markable layer or layers contain additional layers, such as for example subbing layers, an outer layer that is suitable as a receiver layer for dyes applied by thermal dye sublimation or inkjet printing, or intermediate layers between the laser markable layer and the support to improve the adhesion or between the laser markable layers to prevent colour contamination.

Figure 2:
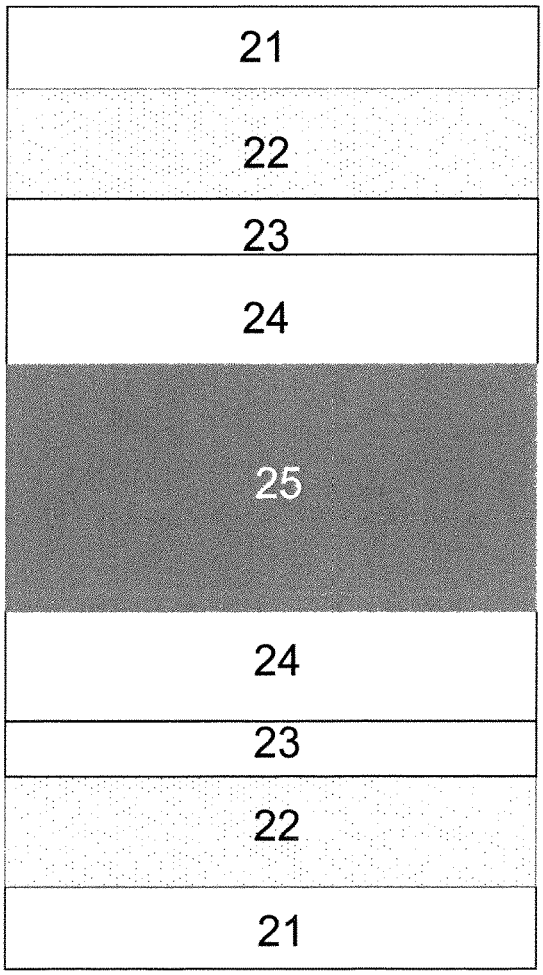

In a preferred embodiment, the laser markable material is provided, for example laminated, on a core support, preferably on both sides of the core support (see FIG. 2). Such laser markable material is preferably a colour laser markable security document precursor or security document.

In a preferred embodiment, the colour laser marked document is a security document, preferably selected from the group consisting of a passport, a personal identification card and a product identification document.

The colour laser markable document preferably also contains electronic circuitry, more preferably the electronic circuitry includes a RFID chip with an antenna and/or a contact chip. The security document is preferably a "smart card", meaning an identification card incorporating an integrated circuit. In a preferred embodiment the smart card includes a radio frequency identification or RFID-chip with an antenna. Inclusion of electronic circuitry makes forgery more difficult.

The colour laser markable document preferably has a format as specified by ISO 7810. ISO 7810 specifies three formats for identity cards: ID-1 with the dimensions 85.60 mm×53.98 mm, a thickness of 0.76 mm is specified in ISO 7813, as used for bank cards, credit cards, driving licenses and smart cards; ID-2 with the dimensions 105 mm×74 mm, as used in German identity cards, with typically a thickness of 0.76 mm; and ID-3 with the dimensions 125 mm×88 mm, as used for passports and visa's. When the security cards include one or more contactless integrated circuits then a larger thickness is tolerated, e.g. 3 mm according to ISO 14443-1.

In another preferred embodiment, the colour laser markable document is a product identification document which is usually attached to the packaging material of the product or to the product itself. The product identification document not only allows to verify the authenticity of the product, but also to maintain the attractive look of a product (packaging).

Infrared Absorbing Dyes

Suitable examples of infrared dyes (IR dyes) include, but are not limited to, polymethyl indoliums, metal complex IR dyes, indocyanine green, polymethine dyes, croconium dyes, cyanine dyes, merocyanine dyes, squarylium dyes, chalcogenopyryloarylidene dyes, metal thiolate complex dyes, bis(chalcogenopyrylo)polymethine dyes, oxyindolizine dyes, bis(aminoaryl)polymethine dyes, indolizine dyes, pyrylium dyes, quinoid dyes, quinone dyes, phthalocyanine dyes, naphthalocyanine dyes, azo dyes, (metalized) azomethine dyes and combinations thereof.

A particularly preferred infrared dye is 5-[2,5-bis[2-[1-(1-methylbutyl)-benz[cd]indol-2(1H)-ylidene]ethylidene]cyclopentylidene]-1-butyl-3-(2-methoxy-1-methylethyl)-2,4,6(1H,3H,5H)-pyrimidinetrione (CASRN 223717-84-8) represented by the Formula IR-1:

IR-1

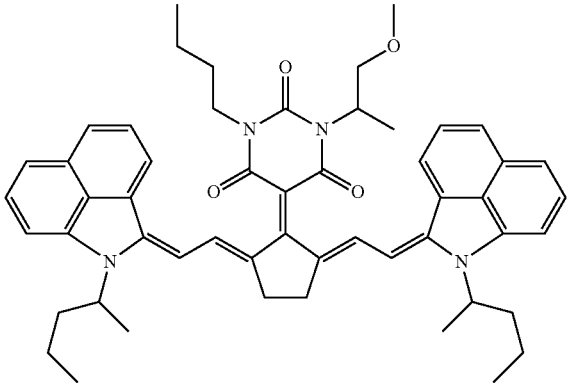

The infrared dye IR-1 has an absorption maximum $\lambda_{max}$ of 1052 nm making it very suitable for a Nd-YAG laser having an emission wavelength of 1064 nm.

Other preferred infrared dyes are those disclosed in EP-A 2722367 and the unpublished EP-A 14166498.7 (filed on Apr. 30, 2014).

The amount of IR dyes is preferably between 0.005 and 1.000 g/m$^2$, more preferably between 0.010 and 0.500 g/m$^2$, most preferably between 0.015 and 0.050 g/m$^2$. Enough IR dye has to be present to ensure sufficient colour density formation upon exposure to IR radiation. However, using too much IR dye may result in unwanted background coloration of the laser markable materials.

Infrared Absorbing Pigments

Suitable examples of infrared absorbing pigments include but are not limited to carbon black such as acetylene black, channel black, furnace black, lamp black, and thermal black; oxides, hydroxides, sulfides, sulfates and phosphates of metals such as copper, bismuth, iron, nickel, tin, zinc, manganese, zirconium, tungsten, lanthanum, and antimony including lanthane hexaboride, indium tin oxide (ITO) and antimony tin oxide, titanium black and black iron oxide.

The infrared dye classes disclosed above may also be used as infrared absorbing pigments, for example cyanine pigment, merocyanine pigment, etc.

A preferred infrared absorbing pigment is carbon black.

The particle size of the pigment is preferably from 0.01 to 10 μm, more preferably from 0.05 to 1 μm.

The amount of the infrared absorbing pigment is between 10 and 1000 ppm, preferably between 25 and 750 ppm, more preferably between 50 and 500 ppm, most preferably between 100 and 250 ppm, all relative to the total dry weight of the laser markable layer. An amount of infrared absorbing pigment above 1000 ppm results in a too high background density of the laser markable article.

Leuco Dyes

All publicly-known leuco dyes can be used and are not restricted. They are for example widely used in conventional pressure-sensitive, photosensitive or thermally-sensitive recording materials. For more information about leuco dyes, see for example Chemistry and Applications of Leuco Dyes, Ramaiah Muthyala, Plenum Press, 1997.

A number of classes of leuco dyes may be used as colour forming compounds in the present invention, such as for example: spiropyran leuco dyes such as spirobenzopyrans (e.g. spiroindolinobenzopyrans, spirobenzo-pyranobenzopyrans, 2,2-dialkylchromenes), spironaphtooxazine and spirothiopyran; leuco quinone dyes; azines such as oxazines, diazines, thiazines and phenazine; phthalide- and phthalimidine-type leuco dyes such as triarylmethane phtalides (e.g. crystal violet lactone), diarylmethane phthalides, monoarylmethane phthalides, heterocyclic substituted phthalides, alkenyl substituted phthalides, bridged phthalides (e.g. spirofluorene phthalides and spirobenzanthracene phthalides) and bisphthalides; fluoran leuco dyes such as fluoresceins, rhodamines and rhodols; triarylmethanes such as leuco crystal violet; ketazines; barbituric acid leuco dyes and thiobarbituric acid leuco dyes.

The laser markable layer(s) may comprise more then one leuco dye, typically to obtain a specific desired colour.

The leuco dye is preferably present in the laser markable layer in an amount of 0.05 to 5.00 g/m$^2$, more preferably in an amount of 0.10 to 3.00 g/m$^2$, most preferably in an amount of 0.20 to 1.00 g/m$^2$.

The following reaction mechanisms and leuco dyes are suitable to form a coloured dye.

1. Protonation of a Leuco Dye after Fragmentation of an Acid Generator

The reaction mechanism can be represented by:

Leuco-dye+acid generator→Leuco-dye+acid→Coloured Dye

All publicly-known photo- and thermal acid generators can be used for the present invention. They can optionally be combined with a photosensitizing dye. Photo- and thermal acid generators are for example widely used in conventional photoresist material. For more information see for example "Encyclopaedia of polymer science", 4th edition, Wiley or "Industrial Photoinitiators, A Technical Guide", CRC Press 2010.

Preferred classes of photo- and thermal acid generators are iodonium salts, sulfonium salts, ferrocenium salts, sulfonyl oximes, halomethyl triazines, halomethylarylsulfone, α-haloacetophenones, sulfonate esters, t-butyl esters, allyl substituted phenols, t-butyl carbonates, sulfate esters, phosphate esters and phosphonate esters.

Preferred Leuco Dyes are phthalide- and phthalimidine-type leco dyes such as triarylmethane phtalides, diarylmethane phthalides, monoarylmethane phthalides, heterocyclic substituted phthalides, alkenyl substituted phthalides, bridged phthalides (e.g. spirofluorene phthalides and spirobenzanthracene phthalides) and bisphthalides; and fluoran Leuco Dyes such as fluoresceins, rhodamines and rhodols.

In a more preferred embodiment of the present invention, a combination is used of at least one compound selected from the group consisting of CASRN 50292-95-0, CASRN 89331-94-2, CASRN1552-42-7 (crystal violet lactone), CASRN148716-90-9, CASRN 630-88-6, CASRN 36889-76-7 or CASRN 132467-74-4 as the Leuco Dye and at least one compound selected from the group consisting of CASRN 58109-40-3, CASRN 300374-81-6, CASRN 1224635-68-0, CASRN 949-42-8, CASRN 69432-40-2, CASRN 3584-23-4, CASRN 74227-35-3, CASRN 953-91-3 or CASRN6542-67-2 as acid generator.

2. Oxidation of a Triarylmethane Leuco Dye

The reaction mechanism can be represented by:

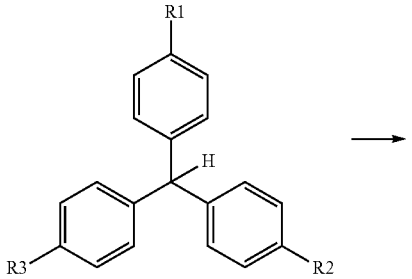

-continued

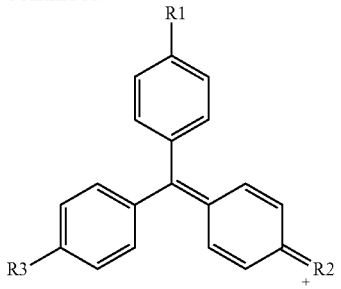

wherein R1, R2 and R3 each independently represent an amino group, an optionally substituted mono- or dialkylamino group, a hydroxyl group or an alkoxy group. R1 and R3 also each independently represent a hydrogen atom or an optionally substituted alkylene, arylene, or heteroarylene. A preferred leuco dye for the present invention is leuco crystal violet (CASRN 603-48-5).

3. Oxidation of a Leuco Quinone Dye

The reaction mechanism can be represented by

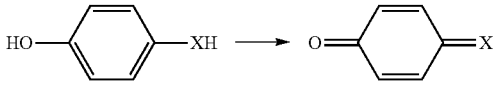

wherein X represents an oxygen atom or an optionally substituted amino or methine group.

4. Fragmentation of a Leuco Dye

The reaction mechanism can be represented by:

Leuco Dye-FG→Dye wherein FG represents a fragmenting group.

Preferred leuco dyes are oxazines, diazines, thiazines and phenazine. A particularly preferred leuco dye (CASRN104434-37-9) is shown in EP 174054 (POLAROID) which discloses a thermal imaging method for forming colour images by the irreversible unimolecular fragmentation of one or more thermally unstable carbamate moieties of an organic compound to give a visually discernible colour shift from colourless to coloured.

The fragmentation of a leuco dye may be catalyzed or amplified by acids, photo acid generators, and thermal acid generators.

5. Ring Opening of Spiropyran Leuco Dyes

The reaction mechanism can be represented by:

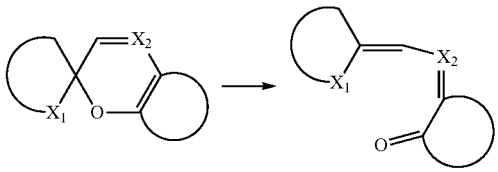

wherein $X_1$ represents an oxygen atom, an amino group, a sulphur atom or a selenium atom and $X_2$ represents an optionally substituted methine group or a nitrogen atom.

The preferred spiropyran leuco dyes for the present invention are spiro-benzopyrans such as spiroindolinobenzopyrans, spirobenzopyranobenzopyrans, 2,2-dialkylchromenes; spironaphtooxazines and spirothiopyrans. In a particularly preferred embodiment, the spiropyran leuco dyes are CASRN 160451-52-5 or CASRN 393803-36-6. The ring opening of a spiropyran leuco dye may be catalyzed or amplified by acids, photo acid generators, and thermal acid generators.

In a preferred embodiment of a laser markable layer for producing a cyan color, the cyan color forming compound has a structure according to Formulae CCFC1, CCFC2 or CCFC3.

CCFC1

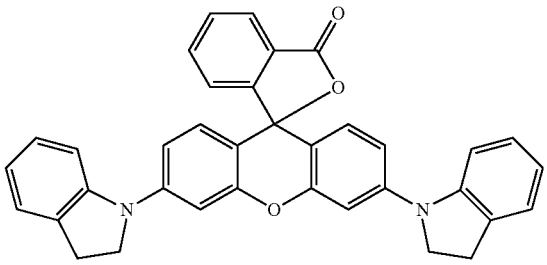

CCFC2

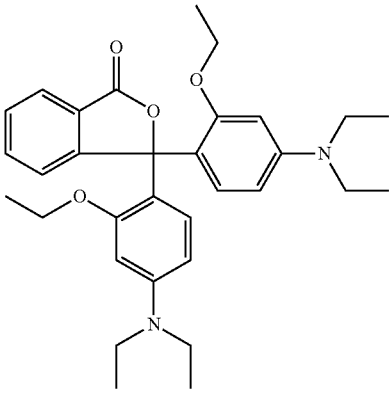

CCFC3

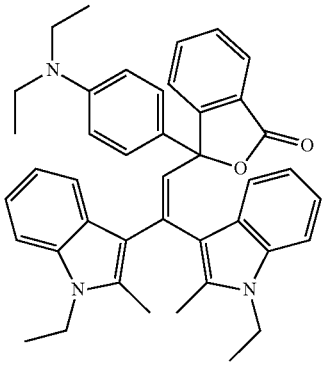

In a preferred embodiment of a laser markable layer for producing a magenta color, the magenta color forming compound has a structure according to Formula MCFC2:

MCFC2

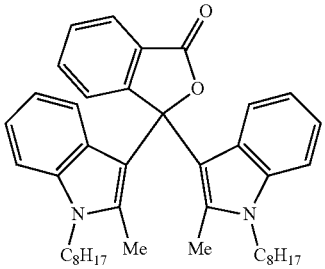

In a preferred embodiment of a laser markable layer for producing a red color, the red color forming compound has a structure according to Formula RCFC:

RCFC

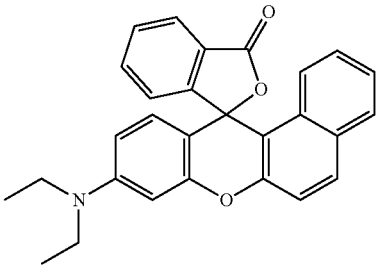

In a preferred embodiment of a laser markable layer for producing a yellow color, the yellow color forming compound has a structure according to Formula YCFC:

YCFC

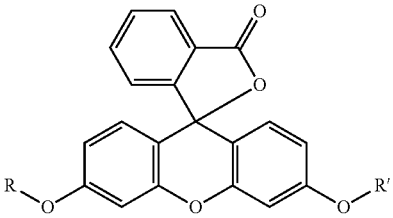

wherein R, Red embodiment of a laser markable layer for producing a yellow color, the yellow color forming compound has a structure according In one embodiment, the yellow color forming compound has a structure according to Formula YCFC, wherein R and R' independently represent a linear alkyl group, a branched alkyl group, an aryl or an aralkyl group substituted by at least one functional group containing an oxygen atom, a sulphur atom or a nitrogen atom.

A particularly preferred yellow color forming compound is the compound according to Formula YCFC wherein both R and R' are methyl.

In a most preferred embodiment of a laser markable layer for producing a yellow color, the yellow color forming compound has a structure according to Formulae YCFC1 or YCFC2

YCFC1

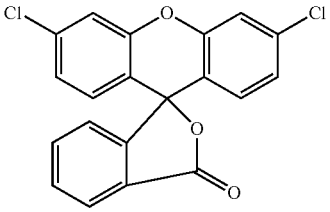

YCFC2

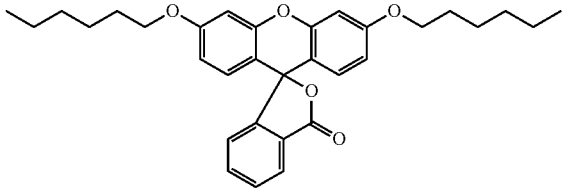

In a preferred embodiment of a laser markable layer for producing a black colour, the black colour forming compound has a structure according to Formula BCFC

BCFC

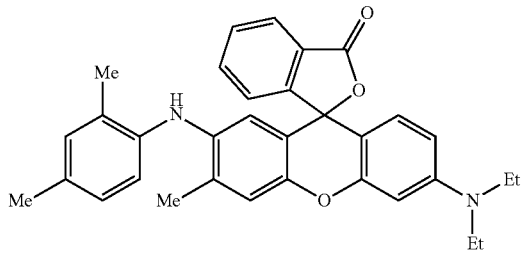

wherein Me=methyl and Et=Ethyl.

Polymeric Binder

The laser markable layer may include a polymeric binder. In principle any suitable polymeric binder that does not prevent the colour formation in the laser markable layer(s) may be used. The polymeric binder may be a polymer, a copolymer or a combination thereof.

The laser markable layer preferably includes a polymeric binder comprising vinyl acetate and at least 85 wt % of vinyl chloride based on the total weight of the binder. The polymeric binder is preferably a copolymer including at least 85 wt % of a vinyl chloride and 1 wt % to 15 wt % of vinyl acetate, more preferably a copolymer including at least 90 wt % of a vinyl chloride and 1 wt % to 10 wt % of vinyl acetate with all wt % based on the total weight of the binder.

In a preferred embodiment, the polymeric binder includes at least 4 wt % of vinyl acetate based on the total weight of the binder. The advantage of having at least 4 wt % of vinyl acetate in the polymeric binder is that the solubility of the polymeric binder is drastically improved in preferred coating solvents, such as methyl ethyl ketone.

In a more preferred embodiment, the polymeric binder consists of vinyl chloride and vinyl acetate.

The polymeric binder is preferably present in the colour forming layer in an amount of 1 to 30 g/m$^2$, more preferably in an amount of 2 to 20 g/m$^2$, most preferably in an amount of 3 to 10 g/m$^2$.

Acid Scavenger

The laser markable layer may contain one or more acid scavengers.

Acid scavengers include organic or inorganic bases. Examples of the inorganic bases include hydroxides of alkali metals or alkaline earth metals; secondary or tertiary phosphates, borates, carbonates; quinolinates and metaborates of alkali metals or alkaline earth metals; a combination of zinc hydroxide or zinc oxide and a chelating agent (e.g., sodium picolinate); hydrotalcite such as Hycite 713 from Clariant; ammonium hydroxide; hydroxides of quaternary alkylammoniums; and hydroxides of other metals. Examples of the organic bases include aliphatic amines (e.g., trialkylamines, hydroxylamines and aliphatic polyamines); aromatic amines (e.g., N-alkyl-substituted aromatic amines, N-hydroxylalkyl-substituted aromatic amines and bis[p-(dialkylamino) phenyl]-methanes), heterocyclic amines, amidines, cyclic amidines, guanidines and cyclic guanidines.

Other preferred acid scavangers are HALS compounds. Example of suitable HALS include Tinuvin™ 292, TinuvinT™123, Tinuvin™ 1198, Tinuvin™ 1198 L, Tinuvin™ 144, Tinuvin™ 152, Tinuvin™ 292, Tinuvin™ 292 HP, Tinuvin™ 5100, Tinuvin™ 622 SF, Tinuvin™ 770 DF, Chimassorb™ 2020 FDL, Chimassorb™ 944 LD from BASF; Hostavin 3051, Hostavin 3050, Hostavin N 30, Hostavin N321, Hostavin N 845 PP, Hostavin PR 31 from Clariant.

Further examples of acid scavengers are salts of weak organic acids such as carboxilates (e.g. calcium stearate).

A preferred acid scavanger is an organic base, more preferably an amine.

A particular preferred acid scavenger is an organic base having a pKb of less than 7.

UV Absorbers

The laser markable article may also comprise an UV-absorber. The UV-absorber may be present in a laser markable layer or may also be present in another layer, for example, an outer layer. In a preferred embodiment, the UV-absorber is present in an outer layer.

Examples of suitable UV-absorbers include 2-hydroxyphenyl-benzophenones (BP) such as Chimassorb™ 81 and Chimassorb™ 90 from BASF; 2-(2-hydroxyphenyl)-benzotriazoles (BTZ) such as Tinuvin™ 109, Tinuvin™ 1130, Tinuvin™ 171, Tinuvin™ 326, Tinuvin™ 328, Tinuvin™ 384-2, Tinuvin™ 99-2, Tinuvin™ 900, Tinuvin™ 928, Tinuvin™ Carboprotect™, Tinuvin™ 360, Tinuvin™ 1130, Tinuvin™ 327, Tinuvin™ 350, Tinuvin™ 234 from BASF, Mixxim™ BB/100 from FAIRMOUNT, Chiguard 5530 from Chitec; 2-hydroxy-phenyl-s-triazines (HPT) such as Tinuvin™ 460, Tinuvin™ 400, Tinuvin™ 405, Tinuvin™ 477, Tinuvin™ 479, Tinuvin™ 1577 ED, Tinuvin™ 1600 from BASF, 2-(2,4-dihydroxyphenyl)-4,6-bis-(2,4-dimethylphenyl)-s-triazine (CASRN1668-53-7) from Capot Chemical Ltd and 4-[4,6-bis(2-methyl-phenoxy)-1,3,5-triazin-2-yl]-1,3-benzenediol (CASRN13413-61-1); titanium dioxide such as Solasorb 100F from from Croda Chemicals; zink oxide such as Solasorb 200F from Croda Chemicals; benzoxazines such as Cyasorb UV-3638 F, CYASORBTN UV-1164 from CYTEC; and oxamides such as Sanduvor VSU from Clariant.

Preferred UV absorbers have in the wavelength region between 300 and 400 nm a maximum absorption above 330 nm, more preferably above 350 nm.

Particular preferred UV absorbers are hydroxyphenyl benzotriazoles and 2-hydroxyphenyl-s-triazines having a maximum absorption above 350 nm in the wavelength region 300-400 nm.

The UV-absorber may be present in a laser markable layer or may also be present in another layer, for example, an outer layer. In a preferred embodiment, the UV-absorber is present in an outer layer.

Polymeric Supports

The colour laser markable material preferably includes a support, more preferably a transparent polymeric support, more preferably a transparent axially stretched polyester support. The laser markable layer is coated directly on the polymeric support or on a subbing layer present on the polymeric support for improving adhesion of the laser markable layer, thereby preventing falsification through delamination.

Suitable transparent polymeric supports include cellulose acetate propionate or cellulose acetate butyrate, polyesters such as polyethylene terephthalate and polyethylene naphthalate, polyamides, polycarbonates, polyimides, polyolefins, polyvinylchlorides, polyvinylacetals, polyethers and polysulphonamides.

In a most preferred embodiment, the transparent polymeric support is a biaxially stretched polyethylene terephthalate foil (PET-C foil) to be very durable and resistant to scratches and chemical substances.

The support preferably is a single component extrudate, but may also be a co-extrudate. Examples of suitable co-extrudates are PET/PETG and PET/PC.

Polyester supports and especially polyethylene terephthalate supports are preferred because of their excellent properties of dimensional stability. When polyester is used as the support material, a subbing layer is preferably employed to improve the bonding of layers, foils and/or laminates to the support.

The manufacturing of PET-C foils and supports is well-known in the art of preparing suitable supports for silver halide photographic films. For example, GB 811066 (ICI) teaches a process to produce biaxially oriented polyethylene terephthalate foils and supports.

The polyethylene terephthalate is preferably biaxially stretched with a stretching factor of at least 2.0, more preferably at least 3.0 and most preferably a stretching factor of about 3.5. The temperature used during stretching is preferably about 160° C.

Methods to obtain opaque polyethylene terephthalate and biaxially oriented films thereof of have been disclosed in, e.g. US2008/238086.

Subbing Layers

The polymeric support may be provided with one or more subbing layers. This has the advantage that the adhesion between the laser markable layer and the polymeric support is improved.

Useful subbing layers for this purpose are well known in the photographic art and include, for example, polymers of vinylidene chloride such as vinylidene chloride/acrylonitrile/acrylic acid terpolymers or vinylidene chloride/methyl acrylate/itaconic acid terpolymers.

The application of subbing layers is well-known in the art of manufacturing polyester supports for silver halide photographic films. For example, the preparation of such subbing layers is disclosed in U.S. Pat. No. 3,649,336 (AGFA) and GB1441591 (AGFA);

Suitable vinylidene chloride copolymers include: the copolymer of vinylidene chloride, N-tert.-butylacrylamide, n-butyl acrylate, and N-vinyl pyrrolidone (e.g. 70:23:3:4), the copolymer of vinylidene chloride, N-tert.-butylacrylamide, n-butyl acrylate, and itaconic acid (e.g. 70:21:5:2), the copolymer of vinylidene chloride, N-tert.-butylacrylamide, and itaconic acid (e.g. 88:10:2), the copolymer of vinylidene chloride, n-butylmaleimide, and itaconic acid (e.g. 90:8:2), the copolymer of vinyl chloride, vinylidene chloride, and methacrylic acid (e.g. 65:30:5), the copolymer of vinylidene chloride, vinyl chloride, and itaconic acid (e.g. 70:26:4), the copolymer of vinyl chloride, n-butyl acrylate, and itaconic acid (e.g. 66:30:4), the copolymer of vinylidene chloride, n-butyl acrylate, and itaconic acid (e.g. 80:18:2), the copolymer of vinylidene chloride, methyl acrylate, and itaconic acid (e.g. 90:8:2), the copolymer of vinyl chloride, vinylidene chloride, N-tert.-butylacrylamide, and itaconic acid (e.g. 50:30:18:2). All the ratios given between brackets in the above-mentioned copolymers are ratios by weight.

In a preferred embodiment, the subbing layer has a dry thickness of no more than 2 μm or preferably no more than 200 mg/m$^2$.

Coating Solvents

For coating the laser markable layer(s) and the optional addition layers such as an outer layer or an intermediate layer, one or more organic solvents may be used. The use of an organic solvent facilitates the dissolution of the polymeric binder and specific ingredients such as the infrared dye.

A preferred organic solvent is methylethylketone (MEK) because it combines a high solubilizing power for a wide range of ingredients and it provides, on coating the laser markable layer, a good compromise between the fast drying of the layer(s) and the danger of fire or explosion thereby allowing high coating speeds.

Additional Layers

The laser markable material may in addition to the laser markable layer or layers contain additional layers, such as for example subbing layers, an outer layer that is suitable as a receiver layer for dyes applied by thermal dye sublimation or even inkjet printing, or intermediate layers between the laser markable layer and the support to improve the adhesion or between the laser markable layers to prevent colour contamination.

A preferred embodiment of a laser markable material according to the present invention is shown in FIG. 1. An outer layer (11) is provided on one side of a transparent polymeric support (12), preferably a PET-C foil. An intermediate layer (13) and a laser markable layer (14) are provided on the other side of the polymeric support.

Another preferred embodiment of a laser markable material, a security document precursor, is shown in FIG. 2. The laser markable material as shown in FIG. 1 is laminated on both sides of core support (25), preferably an opaque core support.

Core Supports

The colour laser markable document precursor or document may include a core support. The core support may be transparent or opaque. The core support is preferably an opaque white core support. The advantage of an opaque white core support is that any information present on the document is more easily readable and that a colour image is more appealing by having a white background.

Preferred opaque white core supports include resin coated paper supports, such as polyethylene coated paper and polypropylene coated paper, and synthetic paper supports such as Synaps™ synthetic paper of Agfa-Gevaert NV.

Other examples of useful high-quality polymeric supports for the present invention include opaque white polyesters and extrusion blends of polyethylene terephthalate and polypropylene. Also Teslin™ may be used as support.

Instead of a white support, a white opacifying layer can be coated onto a transparent polymeric support, such as those disclosed above. The opacifying layer preferably contains a white pigment with a refractive index greater than 1.60, preferably greater than 2.00, and most preferably greater than 2.60. The white pigments may be employed singly or in combination. Suitable white pigments include C.I. Pigment White 1, 3, 4, 5, 6, 7, 10, 11, 12, 14, 17, 18, 19, 21, 24, 25, 27, 28 and 32. Preferably titanium dioxide is used as pigment with a refractive index greater than 1.60. Titanium oxide occurs in the crystalline forms of anatase type, rutile type and brookite type. In the present invention the rutile type is preferred because it has a very high refractive index, exhibiting a high covering power.

Laser Marking Methods

The method for preparing a laser marked document comprises the steps of:

a) laminating a laser markable material according to the present invention onto a core support; and
b) laser marking the laser markable material by an infrared laser.

In a preferred embodiment the infrared laser operates in a pulsed mode. In an even more preferred embodiment, the pulse repetition rate is 15 kHz or more.

Another preferred method for preparing a laser marked article uses three infrared lasers L-1, L-2 and L-3 having respectively a laser emission wavelength of λ (L-1), λ (L-2) and λ (L-3) and comprises the steps of:

laser marking with the infrared laser L-1 a first laser markable layer including an infrared dye IR-1 having an absorption maximum in the infrared region $\lambda_{max}$(IR-1);

laser marking with the infrared laser L-2 a second laser markable layer including an infrared dye IR-2 having an absorption maximum in the infrared region $\lambda_{max}$(IR-2);

laser marking with the infrared laser L-3 a third laser markable layer including an infrared dye IR-3 having an absorption maximum in the infrared region $\lambda_{max}$(IR-3), wherein, the laser emission wavelengths satisfy the condition of:

$$\lambda(L\text{-}1)>\lambda(L\text{-}2)>\lambda(L\text{-}3);$$

the infrared red dye absorption maxima satisfy the condition of:

$$\lambda_{max}(\text{IR-1})>\lambda_{max}(\text{IR-2})>\lambda_{max}(\text{IR-3});$$

and wherein all laser markable layers also include between 10 and 1000 ppm of an infrared absorbing pigment and a leuco dye.

In a preferred embodiment of the method, the core support is an opaque white core support. In a particular preferred embodiment of the method, the opaque white core support is a PETG support.

Preferably laser marking is carried out through the transparent polymer support of the laser markable material.

The laser marked document is preferably a security document selected from the group consisting of a passport, a personal identification card and a product identification document.

Other Security Features

The laser markable article is preferably combined with one or more other security features to increase the difficulty for falsifying the document.

To prevent forgeries of identification documents, different means of securing are used. One solution consists in superimposing lines or guilloches on an identification picture such as a photograph. In that way, if any material is printed subsequently, the guilloches appear in white on added black background. Other solutions consist in adding security elements such as information printed with ink that reacts to ultraviolet radiation, micro-letters concealed in an image or text etc.

Suitable other security features such as anti-copy patterns, guilloches, endless text, miniprint, microprint, nanoprint, rainbow colouring, 1D-barcode, 2D-barcode, coloured fibres, fluorescent fibres and planchettes, fluorescent pigments, OVD and DOVID (such as holograms, 2D and 3D holograms, Kinegrams™, overprint, relief embossing, perforations, metallic pigments, magnetic material, Metamora colours, microchips, RFID chips, images made with OVI (Optically Variable Ink) such as iridescent and photochromic ink, images made with thermochromic ink, phosphorescent pigments and dyes, watermarks including duotone and multitone watermarks, ghost images and security threads.

EXAMPLES

Materials

All materials used in the following examples were readily available from standard sources such as ALDRICH CHEMICAL Co. (Belgium) and ACROS (Belgium) unless otherwise specified. The water used was deionized water.

CCE is Bayhydrol H 2558, an anionic polyester urethane (37.3%) from BAYER.

Resorcinol from Sumitomo Chemicals.

Par is a dimethyltrimethylolamine formaldehyde resin from Cytec industries.

PAR-sol is a 40 wt % aqueous solution of Par.

PEA is Tospearl™ 120 from Momentive Performance materials.

PEA-sol is a 10 wt % (50/50) aqueous/ethanol dispersion of PEA.

Dowfax™ 2A1 from Pilot Chemicals C is a Alkyldiphenyloxide disulfonate (4.5% wt %).

DOW-sol is a 2.5 wt % solution of Dowfax™ 2A1 in isopropanol.

Surfynol™ 420 from Air Products is a non ionic surfactant.

Surfynsol is a 2.5 wt % solution of Surfynol™ 420 in isopropanol.

MEK is an abbreviation used for methylethylketone.

Solvin™ 557RB is a vinylchloride-vinylacetate copolymer with 11% vinyl acetate, provided by SOLVAY.

Baysilone® Paint Additive MA is a methylpolysiloxane from Bayer.

Baysol is a 5 wt % solution of Baysilone® Paint Additive MA in MEK.

HALS is Tinuvin 770 commercially available from BASF.

IR1 is an IR dye with the following formula and prepared as disclosed in EP-A 2463109 (Agfa), paragraphs [0150] to [0159].

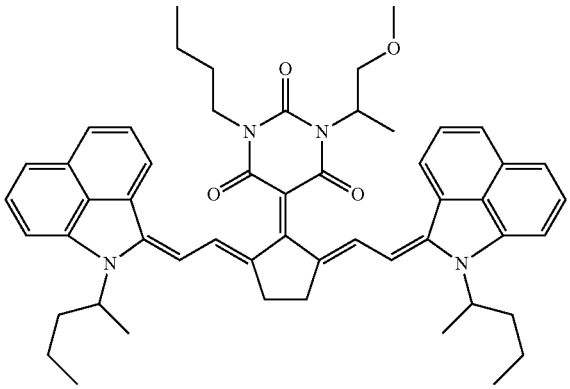

LD1 is the leuco dye Pergascript Black 2C from BASF.

LD2 is the leuco dye Pergascript Red I 6Bf from BASF.

ORGASOL is ORGASOL™ 3501 EXD NAT 1, a spheroidal powder of copolyamide 6/12, with 10 μm as average diameter from Orgasol.

Printex 25 is a carbon black from Degussa.

MK8600 is a 0.04 wt % dispersion of Printex 25 in MEK.

Sunvac HH, a vinylchloride-vinylacetate copolymer with 14% vinyl acetate, provided by SUNYCHEM.

TOSPEARL 145 is a polymethylsilsesquioxane with an average particle size 4.5 μm from GENERAL ELECTRIC.

Tinuvin 460 is an UV absorber from BASF.

Solbin A is a vinyl chloride-vinyl acetate-vinyl alcohol copolymer from NISSIN CHEMICAL Co.

ZnOct is zinc octanoate from AKROS.

Desmodur N75 is an aliphatic polyisocyanate resin from BAYER.

Measurement Methods

1. Optical Density

The optical density (OD) was measured in reflection using a spectrodensitometer Type GretagMacbeth SPM50 using a visual filter.

2. Laser Marking

The security documents were laser marked using a Rofin RSM Powerline E laser (10 W) with settings 34 ampere and 33 kHz at 100% power.

3. Absorption Spectra

The absorption spectra were measured on a PerkinElmer Lambda 950 from Perkin Elmer.

Example 1

Preparation of PET-C Foil PET-1

A coating composition SUB-1 was prepared by mixing the components according to Table 1 using a dissolver.

TABLE 1

| Components of SUB-1 | wt % |
|---|---|
| deionized water | 76.66 |
| CCE | 18.45 |
| Resorcinol | 0.98 |
| PAR-sol | 0.57 |
| PEA-sol | 0.68 |
| DOW-sol | 1.33 |
| Surfynsol | 1.33 |

A 1100 μm thick polyethylene terephthalate sheet was first longitudinally stretched and then coated on both sides with the coating composition SUB-1 at a wet thickness of 10 μm. After drying, the longitudinally stretched and coated polyethylene terephthalate sheet was transversally stretched to produce a 63 μm thick sheet PET-1, which was transparent and glossy.

Preparation of Coating Solution for the Outerlayer OUT-1

The coating composition OUT-1 was prepared by mixing the components according to Table 2 using a dissolver.

TABLE 2

| Ingredient (g) | OUT-1 |
|---|---|
| MEK | 87.45 |
| Sunvac HH | 10.58 |
| TOSPEARL 145 | 0.02 |
| Tinuvin 460 | 1.97 |

Preparation of Coating Solution for the Intermediate Layer INT-1

The coating composition INT-1 was prepared by mixing the components according to Table 3 using a dissolver.

TABLE 3

| Ingredient (g) | INT-1 |
|---|---|
| MEK | 97.3 |
| Solbin A | 2.0 |
| ZnOct | 0.06 |
| Desmodur N75 | 0.69 |

Preparation of the Coating Solutions for the Laser Markable Layers LML-1 to LML-6

The coating compositions LML-1 to LML-6 were all prepared by mixing the components according to Table 4 using a dissolver.

TABLE 4

| Ingredient (g) | LML-1 | LML-2 | LML-3 | LML-4 | LML-5 | LML-6 |
|---|---|---|---|---|---|---|
| MEK | 75.0 | 73.0 | 72.0 | 71.0 | 70.0 | 68.5 |
| SolvinTM 557RB | 9.5 | = | = | = | = | = |
| BAYSOL | 1.0 | = | = | = | = | = |
| HALS | 0.067 | = | = | = | = | = |
| IR1 (3 wt % in MEK) | 12.91 | = | = | = | = | = |
| MK8600 | 0 | 2.30 | 3.45 | 4.60 | 5.75 | 6.90 |
| Orgasol | 0.00440 | = | = | = | = | = |
| LD1 | 0.971 | = | = | = | = | = |
| LD2 | 0.645 | = | = | = | = | = |

Preparation of the Laser Markable Laminates LMLA-1 to LMLA-6

An outer layer was prepared by coating the coating solution OUT-1 on one side of the PET-C foil PET-1 at a wet coating thickness of 60 μm and dried at 90° C. during 6 minutes.

An intermediate layer was prepared by coating the coating solution INT-1 on the other side of the PET-C foil PET1 at a wet coating thickness of 29 μm and dried at 90° C. during 3 minutes.

The Laser Markable Laminates LMLA-1 to LMLA-6 were then obtained by coating the coating solutions LML-1 to LML-6 on the intermediate layer at a wet coating thickness of 68 μm and dried at 90° C. during 6 minutes.

The composition of the dried Laser Markable Layers LML-1 to LML-6 of the Laser Markable Laminates LMLA-1 to LMALA-6 was according to Table 5.

TABLE 5

| Ingredient | LML-1 | LML-2 | LML-3 | LML-4 | LML-5 | LML-6 |
|---|---|---|---|---|---|---|
| SolvinTM 557RB (g/m2) | 5.300 | = | = | = | = | = |
| BAYSOL (g/m2) | 0.557 | = | = | = | = | = |
| HALS (g/m2) | 0.037 | = | = | = | = | = |
| IR1 (g/m2) | 0.022 | = | = | = | = | = |
| Printex 25 (ppm)* | 0 | 82 | 123 | 164 | 205 | 246 |
| Orgasol 3501 (mg/m2) | 2.45 | = | = | = | = | = |
| LD1 (g/m2) | 0.541 | = | = | = | = | = |
| LD2 (g/m2) | 0.360 | = | = | = | = | = |

*relative to the total weight of the LML

Preparation of the Laser Markable Articles LMA-1 to LMA-6

The Laser Markable Laminates LMLA-1 to LMLA-6 were laminated on both sides of a 600 μm PETG CORE (from Wolfen) using an OASYS OLA 6H laminator (130° C.-220 sec).

Laser Marking LMA-1 to LMA-6

The Laser Markable Articles LMA-1 to 6 were then laser marked through a step wedge to obtain Optical Densities at different exposure levels (see Table 6).

TABLE 6

| Exposure level | Optical Density (OD) LMA-1 | LMA-2 | LMA-3 | LMA-4 | LMA-5 | LMA-6 |
|---|---|---|---|---|---|---|
| 0% | 0.14 | 0.14 | 0.16 | 0.15 | 0.16 | 0.16 |
| 20% | 0.17 | 0.30 | 0.46 | 0.50 | 0.59 | 0.73 |
| 30% | 0.21 | 0.40 | 0.65 | 0.58 | 0.73 | 0.91 |
| 40% | 0.46 | 0.62 | 1.00 | 0.74 | 1.04 | 1.24 |
| 50% | 0.73 | 0.86 | 1.33 | 0.96 | 1.33 | 1.39 |
| 60% | 0.97 | 1.05 | 1.58 | 1.34 | 1.52 | 1.56 |
| 70% | 1.11 | 1.19 | 1.63 | 1.32 | 1.59 | 1.57 |
| 80% | 1.54 | 1.44 | 1.86 | 1.50 | 1.71 | 1.72 |
| 90% | 2.21 | 1.86 | 2.19 | 1.98 | 1.85 | 1.93 |
| 100% | 2.41 | 2.31 | 2.42 | 2.39 | 2.28 | 2.19 |

Figure 3:
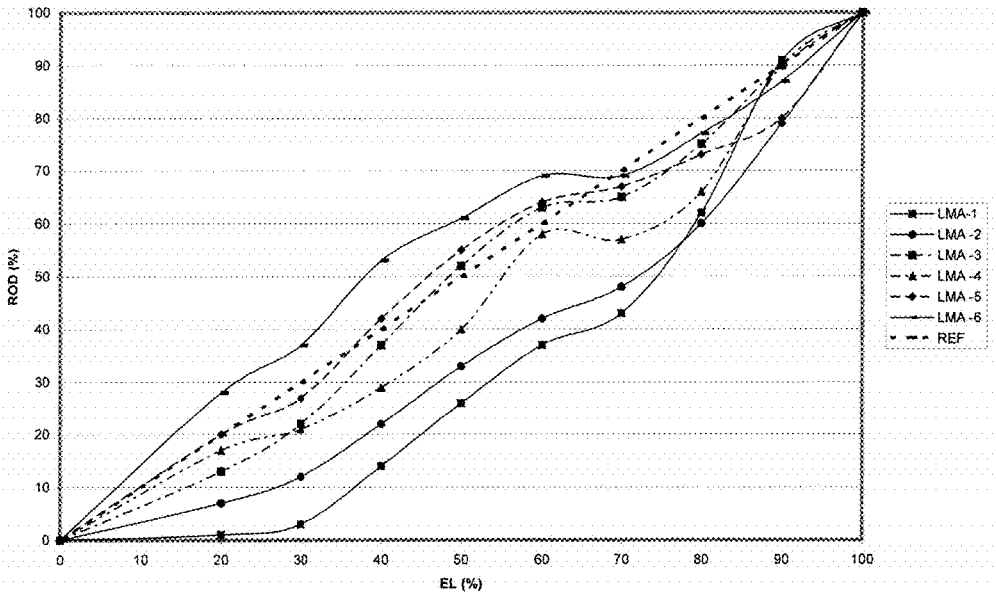
FIG. 3 shows the Relative Optical Density (ROD) of the Laser Markable Articles of example 1 as function of the Exposure Level (EL).

Table 7 and FIG. 3 show "Relative Optical Densities" (ROD) at the different exposure levels of Table 6. The ROD for each exposure level (EL) is calculated according to the following formula:

$$ROD\ EL(x\ \%)=[OD\ EL(x\ \%)-OD\ EL(0\%)]/[OD\ EL(100\%)-OD\ EL(0\%)]*100$$

TABLE 7

| Exposure level | Relative Optical Density (ROD) LMA-1 | LMA-2 | LMA-3 | LMA-4 | LMA-5 | LMA-6 |
|---|---|---|---|---|---|---|
| 0% | 0 | 0 | 0 | 0 | 0 | 0 |
| 20% | 1 | 7 | 13 | 17 | 20 | 28 |
| 30% | 3 | 12 | 22 | 21 | 27 | 37 |
| 40% | 14 | 22 | 37 | 29 | 42 | 53 |
| 50% | 26 | 33 | 52 | 40 | 55 | 61 |
| 60% | 37 | 42 | 63 | 58 | 64 | 69 |
| 70% | 43 | 48 | 65 | 57 | 67 | 69 |
| 80% | 62 | 60 | 75 | 66 | 73 | 77 |
| 90% | 91 | 79 | 90 | 90 | 80 | 87 |
| 100% | 100 | 100 | 100 | 100 | 100 | 100 |

In FIG. 3 the ROD at the different exposure levels for the different laser markable articles LMA-1 to 6 are shown together with a reference line (REF). This reference line reflects an ideal laser markable material wherein the Relative Optical Density (ROD) varies in a linear manner as function of the laser exposure level (LE). In that case, all elements of a picture, in the low, medium and high exposure levels, will be optimally rendered.

It is clear from FIG. 3 that with the comparative Laser Markable Article wherein only IR dye is present in the laser markable layer, the rendition of details in the lower exposure levels (from 0 to 30%) is poor.

When an infrared absorbing pigment (carbon black) is added (LMA-2 to LMA-6) details, even at the lowest exposure levels, will become visible.

Example 2

Preparation of the Coating Solutions for the Laser Markable Layers LML-7 to LML-9

The coating solutions LML-7 to LML-9 were prepared by mixing the components according to Table 8 using a dissolver.

TABLE 8

| Ingredient (g) | LML-7 | LML-8 | LML-9 |
|---|---|---|---|
| MEK | 75.0 | 73.5 | 72.2 |
| Solvin ™ 557RB | 9.5 | = | = |

TABLE 8-continued

| Ingredient (g) | LML-7 | LML-8 | LML-9 |
|---|---|---|---|
| BAYSOL | 1.0 | = | = |
| HALS | 0.067 | = | = |
| IR1 (3 wt % in MEK) | 12.91 | = | = |
| MK8600 | 0 | 70.0 | 140.0 |
| Orgasol | 0.00440 | = | = |
| LD1 | 0.971 | = | = |
| LD2 | 0.645 | = | = |

Preparation of the Laser Markable Articles LMA-7 to LMA-9

The Laser Markable Articles LMA-7 to MLA-9 were prepared as described in Example 1, but now using the Laser Markable Layers LML-7 to LML-9.

The composition of the dried laser markable layers LML-7 to LML-9 is shown in Table 9.

TABLE 9

| Ingredient | LML-7 | LML-8 | LML-9 |
|---|---|---|---|
| SolvinTM 557RB (g/m2) | 5.200 | = | = |
| BAYSOL (g/m2) | 0.550 | = | = |
| HALS (g/m2) | 0.037 | = | = |
| IR1 (g/m2) | 0.021 | = | = |
| Printex 25 (ppm)* | 0 | 230 | 460 |
| Orgasol 3501 (mg/m2) | 2.44 | = | = |
| LD1 (g/m2) | 0.533 | = | = |
| LD2 (g/m2) | 0.354 | = | = |

*relative to the total weight of the LML

LMA-7 to LMA-9 were then laser marked and evaluated as described in Example 1. Table 10 and FIG. 4 show the Relative Optical Densities (ROD) at the different exposure levels.

TABLE 10

| Exposure level | Relative Optical Density (ROD) % LMA-7 | LMA -8 | LMA -9 |
|---|---|---|---|
| 0% | 0 | 0 | 0 |
| 20% | 1.0 | 17.5 | 26.2 |
| 30% | 2.4 | 21.6 | 31.7 |
| 40% | 5.2 | 27.8 | 43.0 |
| 50% | 11.4 | 34.5 | 51.1 |
| 60% | 18.1 | 41.8 | 60.6 |
| 70% | 24.8 | 50.0 | 69.7 |
| 80% | 42.4 | 62.9 | 79.2 |
| 90% | 62.9 | 75.8 | 88.2 |
| 100% | 100 | 100 | 100 |

Figure 4:
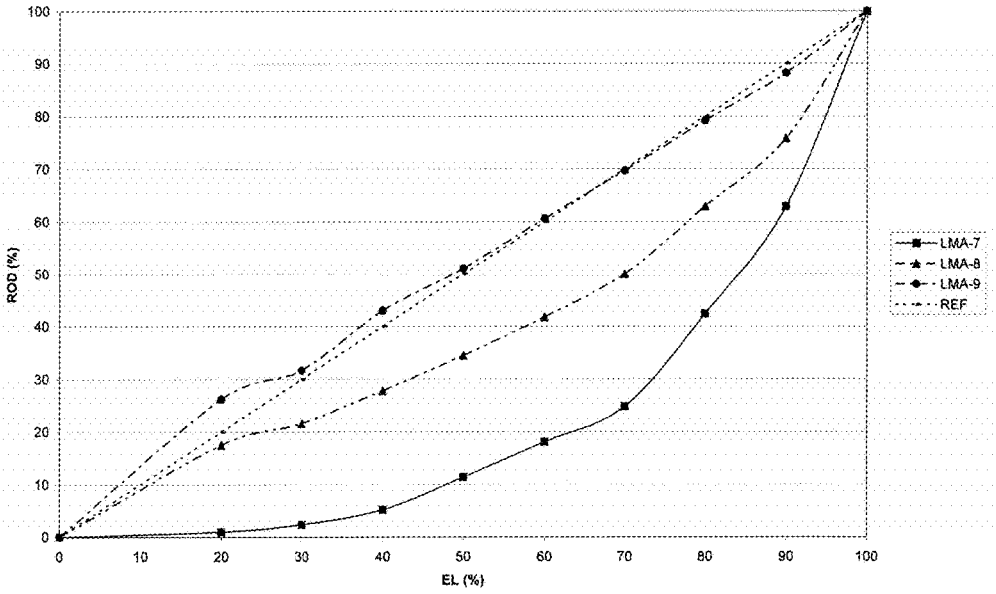
FIG. 4 shows the Relative Optical Density (ROD) of the Laser Markable Articles of example 2 as function of the Exposure Level (EL).

In FIG. 4 the ROD at the different exposure levels for the different laser markable articles LMA-7 to 9 are shown together with a reference line (REF). This reference line reflects an ideal laser markable material wherein the Relative Optical Density (ROD) varies in a linear manner as function of the laser exposure level (LE). In that case, all elements of a picture, in the low, medium and high exposure levels, will be optimally rendered.

It is clear from FIG. 4 that with the comparative Laser Markable Article wherein only IR dye is present in the laser markable layer, the rendition of details in the lower exposure levels (from 0 to 30%) is poor.

When an infrared absorbing pigment (carbon black) is added (LMA-8 and to LMA-9) details, even at the lowest exposure levels, become visible.

Example 3

Preparation of the Coating Solution for the Laser Markable Layers LML-10 to LML-12

The coating solutions LML-10 to LML-12 were prepared by mixing the components according to Table 11 using a dissolver.

TABLE 11

| Ingredient (g) | LML-10 | LML-11 | LML-12 |
|---|---|---|---|
| MEK | 75.1 | 74.0 | 72.0 |
| SolvinTM 557RB | 9.5 | = | = |
| BAYSOL | 1.0 | = | = |
| HALS | 0.067 | = | = |
| IR1 (3 wt % in MEK) | 12.91 | = | 0 |
| MK8600 | 0 | 5.6 | 5.6 |
| Orgasol | 0.00440 | = | = |
| LD1 | 0.971 | = | = |
| LD2 | 0.645 | = | = |

Preparation of the Laser Markable Articles LMA-10 to LMA-12

The Laser Markable Articles LMA-10 to MLA-12 were prepared as described in Example 1, but now using the Laser Markable Layers LML-10 to LML-12.

The composition of the dried laser markable layers LML-10 to LML-12 is shown in Table 12.

TABLE 12

| Ingredient | LML-10 | LML -11 | LML -12 |
|---|---|---|---|
| SolvinTM 557RB (g/m2) | 5.300 | = | = |
| BAYSOL (g/m2) | 0.557 | = | = |
| HALS (g/m2) | 0.037 | = | = |
| IR1 (g/m2) | 0.022 | = | 0 |
| Printex 25 (ppm)* | 0 | 200 | 200 |
| Orgasol 3501 (mg/m2) | 2.45 | = | = |
| LD1 (g/m2) | 0.541 | = | = |
| LD2 (g/m2) | 0.360 | = | = |

*relative to the total weight of the LML

Figure 5:
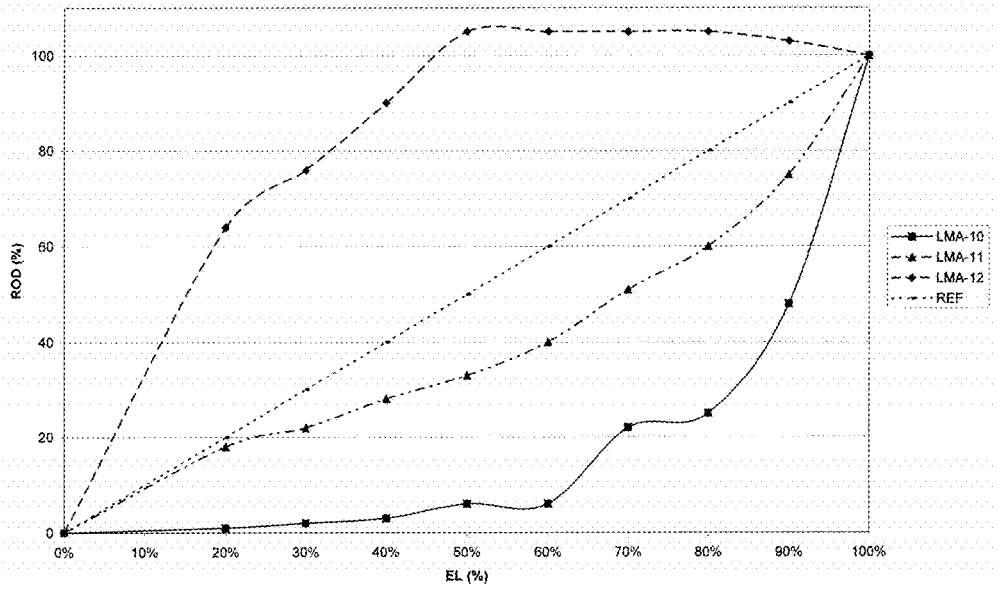
FIG. 5 shows the Relative Optical Density (ROD) of the Laser Markable Articles of example 3 as function of the Exposure Level (EL).

LMA-10 to LMA-12 were then laser marked and evaluated as described in Example 1. Table 13 and FIG. 5 show the Relative Optical Densities (ROD) at the different exposure levels.

TABLE 13

| Exposure | ROD | | | |
|---|---|---|---|---|
| level | LMA-10 | LMA -11 | LMA -12* | REF |
| 0% | 0 | 0 | 0 | 0 |
| 20% | 1 | 18 | 64 | 20 |
| 30% | 2 | 22 | 76 | 30 |
| 40% | 3 | 28 | 90 | 40 |
| 50% | 6 | 33 | 105 | 50 |
| 60% | 6 | 40 | 105 | 60 |
| 70% | 22 | 51 | 105 | 70 |
| 80% | 25 | 60 | 105 | 80 |
| 90% | 48 | 75 | 103 | 90 |
| 100% | 100 | 100 | 100 | 100 |

*30 Ampère

In FIG. 5 the ROD at the different exposure levels for the different laser markable articles LMA-10 to 12 are shown together with a reference line (REF). This reference line reflects an ideal laser markable material wherein the Relative Optical Density (ROD) varies in a linear manner as function of the laser exposure level (LE). In that case, all elements of a picture, in the low, medium and high exposure levels, will be optimally rendered.

It is clear from FIG. 5 that with the comparative Laser Markable Article wherein only IR dye is present in the laser markable layer, the rendition of details in the lower exposure levels (from 0 to 30%) is poor.

When an infrared absorbing pigment (carbon black) is added (LMA-11) details, even at the lowest exposure levels, will become visible.

When only an infrared absorbing pigment is added (LMA-12), carbonization was observed, even at lower exposure energies (30 Ampère for LMA-12 instead of 33 Ampère for LMA-10 and LMA-11).

Figure 6:
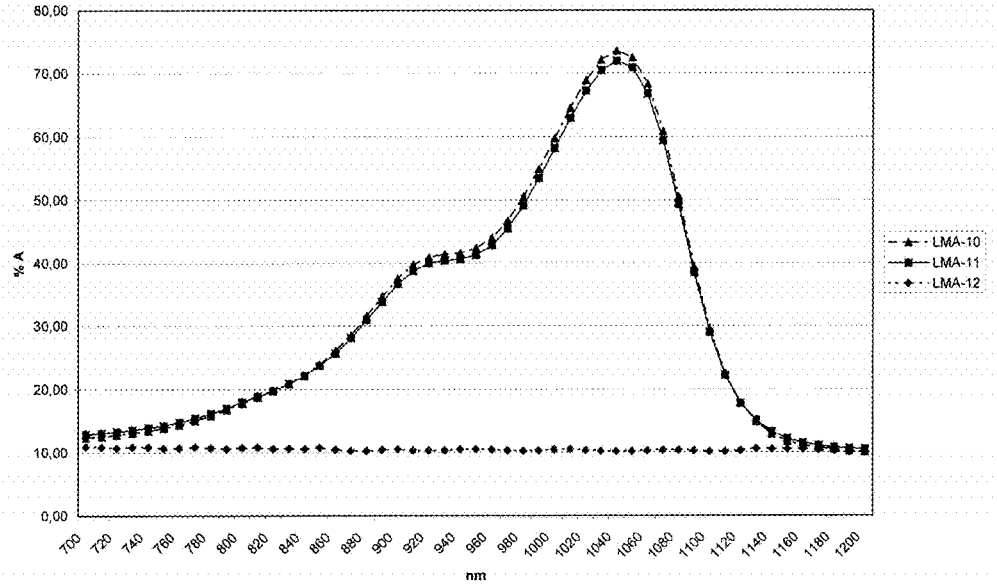
FIG. 6 shows the absorption spectra of the Laser Markable Articles of example 3.

Another disadvantage of a laser markable article containing only an infrared absorbing pigment is their very broad absorption spectrum. This is illustrated by the absorption spectra of LMA-10 to LMA-12 shown in FIG. 6. LMA-10 and LMA-11 have a narrow absorption spectrum with an IR maximum around 1040 nm. The addition of carbon black in LMA-11 does not substantially change the absorption spectrum, while it does have a substantial influence on the colour formation (see above). LMA-12, only containing carbon black, has a very broad absorption spectrum.

The narrow absorption spectra of IR dyes allow the production of multicoloured articles and security documents from precursors having a plurality of laser markable layers containing different IR dyes and colour foming compounds. The IR dyes having a different maximum absorption wavelength can then be addressed by IR lasers with corresponding emission wavelengths causing colour formation only in the laser markable layer of the addressed IR dye.

The invention claimed is:

1. A laser markable article comprising:

a laser markable support or a laser markable layer on a support, the laser markable support or the laser markable layer including an infrared absorbing dye and an infrared absorbing pigment; wherein an amount of the infrared absorbing pigment is between 10 ppm and 1000 ppm relative to a total dry weight of the laser markable support or the laser markable layer; and the laser markable support or the laser markable layer further includes a leuco dye.

2. The laser markable article according to claim 1, wherein the amount of the infrared absorbing pigment is between 50 ppm and 500 ppm relative to the total dry weight of the laser markable support or the laser markable layer.

3. The laser markable article according to claim 1, wherein the infrared absorbing pigment is carbon black.

4. The laser markable article according to claim 1, wherein the laser markable support or the laser markable layer includes a polymeric binder containing vinyl acetate and at least 85 wt % of vinylchloride relative to a total weight of the polymeric binder.

5. The laser markable article according to claim 1, wherein the laser markable support or the laser markable layer includes an acid scavenger.

6. The laser markable article according to claim 5, wherein the acid scavenger is a HALS compound.

7. The laser markable article according to claim 1, wherein the infrared absorbing dye is a polymethine IR dye having an absorption maximum in a region from 800 nm to 1200 nm.

8. The laser markable article according to claim 1, wherein the laser markable layer is provided on the support, and the support is a transparent polymeric support.

9. The laser markable article according to claim 8, further comprising an outer layer and an intermediate layer; wherein the outer layer is provided on a first side of the transparent polymeric support; and the intermediate layer and the laser markable layer are provided on a second side of the transparent polymeric support.

10. The laser markable article according to claim 9, wherein the outer layer includes an UV absorber.

11. A color laser markable document comprising:

a core support; and the laser markable article according to claim 1; wherein the laser markable layer is located between the core support and the support of the laser markable article.

12. A method for preparing a color laser marked document comprising the steps of:

laminating the laser markable article according to claim 1 onto a core support; and laser marking the laser markable article using an infrared laser.

13. The method according to claim 12, wherein the step of laser marking the laser markable article includes operating the infrared laser in a pulsed mode.

14. The method according to claim 12, wherein the color laser marked document is a security document selected from the group consisting of a passport, a personal identification card, and a product identification document.

* * * * *